US008328698B1

(12) United States Patent
Webber et al.

(10) Patent No.: US 8,328,698 B1
(45) Date of Patent: Dec. 11, 2012

(54) EXERCISE BAR ASSEMBLY FOR DUAL ACTION WEIGHTLIFTING MACHINE

(75) Inventors: Randall T. Webber, La Jolla, CA (US); Bruce Hockridge, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 509 days.

(21) Appl. No.: 12/727,552

(22) Filed: Mar. 19, 2010

Related U.S. Application Data

(63) Continuation-in-part of application No. 11/929,372, filed on Oct. 30, 2007, now Pat. No. 7,713,179, which is a continuation of application No. 11/363,677, filed on Feb. 28, 2006, now Pat. No. 7,393,309, application No. 12/727,552, which is a continuation-in-part of application No. 11/940,009, filed on Nov. 14, 2007, now Pat. No. 7,815,555.

(51) Int. Cl.
*A63B 21/078* (2006.01)
*A63B 21/072* (2006.01)

(52) U.S. Cl. ..... 482/104; 482/106; 482/135

(58) Field of Classification Search ..... 482/94, 482/98, 101, 104, 106, 135, 97
See application file for complete search history.

(56) References Cited

U.S. PATENT DOCUMENTS

| | | | |
|---|---|---|---|
| 3,235,255 | A | 2/1966 | Lefler |
| 3,359,802 | A | 12/1967 | Sollenberger |
| 3,606,318 | A | 9/1971 | Gilstrap |
| 3,612,523 | A | 10/1971 | Glynn |
| 3,948,513 | A | 4/1976 | Pfotenhauer |
| 3,953,025 | A | 4/1976 | Mazman |
| 4,072,309 | A | 2/1978 | Wilson |
| 4,252,314 | A | 2/1981 | Ceppo |
| 4,286,782 | A | 9/1981 | Fuhrhop |
| 4,357,010 | A | 11/1982 | Telle |
| RE31,170 | E | 3/1983 | Mazman |
| 4,487,413 | A | 12/1984 | Fall |
| 4,527,797 | A | 7/1985 | Slade |
| 4,564,194 | A | 1/1986 | Dawson |

(Continued)

FOREIGN PATENT DOCUMENTS

FR 1447999 6/1966

(Continued)

OTHER PUBLICATIONS

U.S. Appl. No. 11/929,372, filed Oct. 30, 2007, Webber.

(Continued)

*Primary Examiner* — LoAn H. Thanh
*Assistant Examiner* — Sandhara Ganesan
(74) *Attorney, Agent, or Firm* — Procopio Cory Hargreaves & Savitch LLP

(57) ABSTRACT

A dual action weightlifting machine has a stationary frame including a racking portion and spaced vertical guides slidably mounted on opposite sides of the frame for horizontal movement relative to the frame. A horizontally extending exercise bar assembly has spaced first and second vertical slides slidably mounted on the vertical guides, at least one rotatable user engaging portion for gripping by a user, at least one rack engaging portion comprising a rotatable wear sleeve which rotates independently from the user engaging portion, and opposite first and second end portions for receiving one or more selected weights. The user engaging portion is located between the opposite sides of the frame and has a central longitudinal axis which is coaxial with the cylindrical surfaces of the wear sleeves.

19 Claims, 9 Drawing Sheets

U.S. PATENT DOCUMENTS

| | | | | |
|---|---|---|---|---|
| 4,602,785 | A | 7/1986 | Rockwell | |
| 4,615,524 | A | 10/1986 | Sutherland | |
| 4,664,370 | A | 5/1987 | Finch | |
| 4,700,944 | A | 10/1987 | Sterba | |
| 4,744,560 | A | 5/1988 | Azari | |
| 4,795,149 | A | 1/1989 | Pearson | |
| 4,799,672 | A | 1/1989 | Barrett | |
| 4,836,535 | A | 6/1989 | Pearson | |
| D303,697 | S | 9/1989 | Pearson | |
| D305,256 | S | 12/1989 | Pearson | |
| 4,928,961 | A | 5/1990 | Madden | |
| 4,934,693 | A | 6/1990 | Santoro | |
| 4,955,604 | A | 9/1990 | Pogue | |
| 4,974,838 | A | 12/1990 | Sollenberger | |
| 4,978,122 | A | 12/1990 | Dibowski | |
| 4,979,737 | A | 12/1990 | Kock | |
| 4,982,957 | A | 1/1991 | Shields | |
| 4,998,723 | A | 3/1991 | Santoro | |
| 5,050,868 | A | 9/1991 | Pearson | |
| 5,072,932 | A | 12/1991 | Johnson | |
| 5,135,453 | A | 8/1992 | Sollenberger | |
| 5,151,072 | A | 9/1992 | Cone | |
| 5,184,992 | A | 2/1993 | Banks | |
| 5,215,510 | A | 6/1993 | Baran | |
| 5,257,964 | A | 11/1993 | Petters | |
| 5,273,506 | A | 12/1993 | Dawson, Jr. | |
| 5,334,120 | A | 8/1994 | Rasmussen | |
| 5,407,403 | A | 4/1995 | Coleman | |
| 5,447,308 | A | 9/1995 | Girard | |
| 5,468,203 | A | 11/1995 | Okonkwo | |
| 5,496,243 | A | 3/1996 | Allen | |
| 5,569,133 | A | 10/1996 | Vittone | |
| 5,669,859 | A | 9/1997 | Liggett et al. | |
| 5,842,961 | A | 12/1998 | Davis | |
| 5,971,897 | A | 10/1999 | Olson et al. | |
| 6,120,424 | A | 9/2000 | Arline | |
| D454,930 | S | 3/2002 | Novak | |
| 6,623,409 | B1 | 9/2003 | Abelbeck | |
| 6,663,542 | B1 | 12/2003 | Trabbic | |
| 6,685,601 | B1 | 2/2004 | Knapp | |
| 6,811,521 | B1 | 11/2004 | Musso | |
| 6,926,649 | B2 | 8/2005 | Slawinski | |
| 6,939,274 | B2 | 9/2005 | Emick | |
| D512,471 | S | 12/2005 | Panatta | |
| 6,974,039 | B2 | 12/2005 | Comartin et al. | |
| 7,011,610 | B2 * | 3/2006 | Wawrzyniak | 482/106 |
| 7,014,601 | B2 | 3/2006 | Savage et al. | |
| 7,086,999 | B2 | 8/2006 | Jeneve et al. | |
| 7,097,601 | B1 | 8/2006 | Ronnow | |
| 7,131,937 | B2 | 11/2006 | Skilken et al. | |
| 7,163,496 | B1 | 1/2007 | Trotter | |
| 7,163,498 | B1 | 1/2007 | Abelbeck | |
| D560,089 | S | 1/2008 | DeMeyer | |
| 7,331,911 | B2 | 2/2008 | Webber et al. | |
| 7,364,536 | B2 | 4/2008 | Cappellini et al. | |
| 7,374,516 | B2 | 5/2008 | Lundquist | |
| 7,393,309 | B2 | 7/2008 | Webber | |
| D583,426 | S | 12/2008 | Webber | |
| D590,032 | S | 4/2009 | Webber | |
| 2002/0098953 | A1 | 7/2002 | Scheewe et al. | |
| 2002/0169055 | A1 | 11/2002 | Kras | |
| 2003/0022767 | A1 | 1/2003 | Webber | |
| 2004/0157711 | A1 | 8/2004 | Regev | |
| 2007/0042876 | A1 | 2/2007 | Lundquist | |
| 2007/0066456 | A1 | 3/2007 | Kim | |
| 2007/0203002 | A1 | 8/2007 | Webber | |
| 2008/0051264 | A1 | 2/2008 | Webber | |
| 2009/0124469 | A1 | 5/2009 | Webber | |

FOREIGN PATENT DOCUMENTS

| | | |
|---|---|---|
| FR | 2328486 | 5/1977 |
| WO | WO9220409 | 11/1992 |
| WO | WO9222357 | 12/1992 |

OTHER PUBLICATIONS

U.S. Appl. No. 29/297,619, filed Nov. 14, 2007, Webber.
U.S. Appl. No. 29/297,625, filed Nov. 14, 2007, Webber.
Criterion Bodybuilding Brochure; Leg Machine; Shoulder Machine; Back Machine; Chest Machine, Mass Production, Inc. Criterion Bodybuilding Equipment, date unknown, 12 pages.
Floating Smith Press No. 1330, Serious Lifting Systems Brochure, date unknown, 4 pages.
Hoist Full Cage and Half Cage Ensemble, Hoist Fitness Systems Catalog, 2000, 4 pages.
Hoist HFOPT 900-02, pages from Owner's Manual, Jan. 2000, 5 pages.
LS545 Max Rack, Lamar Health, Fitness & Sports LLC, date unknown, 2 pages.
Max Rack 3-D Flyer, date unknown, 1 page.
Max Rack Pro Trainer, Operation Manual, Max Rack Inc., 1997, 35 pages.
Max Rack Studio Operations Manual, Max Rack Inc., date unknown, 17 pages.
Max Rack U.S. Smith Machines, date unknown, 1 page.
Multi-Adjustable Bench FB321, Life Fitness 2002, 1 page.
Natural Motion Self Sporting Free Weight Machine, Max Rack Brochure, date unknown, 2 pages.
Pending U.S. Appl. No. 11/940,009 to Webber et al. filed Nov. 14, 2007 (not published).
Smith Machine FSSM Life Fitness 2005, 1 page.
Smith Machine PFW-7700, Paramount Fitness 2002, 1 page.
Super Smith II, 2 Axis Smith Machine, Hard Kore Brochure, date unknown, 6 pages.
The Jones, BodyCraft web page, http://www.bodycraft.com/jones.tpl, original date of publication unknown, 1 page.
The Max Rack Squat Machine, Max Rack Inc., date unknown, 1 page.
The Slammer, Positrak brochure, date unknown, 1 page.
Thomson Linear Motion Technology Guide, Thomson Industries Inc., pp. 3 and 9-15, date unknown, 9 pages.
Yukon Caribou II Gym, date unknown.

* cited by examiner

EXERCISE BAR ASSEMBLY FOR DUAL ACTION WEIGHTLIFTING MACHINE

RELATED APPLICATION

The present application is a Continuation In Part of co-pending U.S. patent application Ser. No. 11/929,372 filed on Oct. 30, 2007, which is a Continuation of U.S. patent application Ser. No. 11/363,677 filed on Feb. 28, 2006, now issued as U.S. Pat. No. 7,393,309, and is also a continuation in part of co-pending U.S. patent application Ser. No. 11/940,009 filed on Nov. 14, 2007, and the contents of each of the aforementioned applications are incorporated herein by reference in their entirety.

BACKGROUND

1. Field of the Invention

This invention relates generally to exercise machines, and is particularly concerned with exercise machines of the type which simulate free weight barbell exercise movements.

2. Related Art

Weightlifting machines with weight bars for simulating barbells, also known as Smith machines, have been a fitness club staple for many years. The basic machine has a barbell attached to slide mechanisms which run on vertical guides on opposite sides of a stationary frame. This allows an exerciser to perform exercises with vertical up and down movement, such as squats, bench press exercises, and the like, but does not permit any horizontal movement. The exerciser does not have to worry about balancing the side-to-side or front-to-back movement of an independent, free weight bar. The premise is that this design provides an additional measure of safety and is easy for the neophyte to use.

Dual motion weightlifting machines typically have a horizontal exercise bar which is slidably mounted at its opposite ends on two vertical guide bars. Each vertical guide bar in turn is slidably mounted on horizontal guide bars at its upper and lower ends. This allows the exercise bar to move simultaneously in vertical and horizontal directions, so that the exerciser can perform a more natural feeling weightlifting exercise which allows for the natural horizontal movements of the arms while pushing a weight upwards. The weight bearing bar or exercise bar is normally a standard Olympic bar, which may have hooks attached to it on a rotatable sleeve for hooking onto pinning holes on vertical guides so as to hold the bar in a rest position. The usual weight for an Olympic bar is between forty and fifty pounds. By attaching hooks, bearings, and vertical slides, the weight is dramatically increased. In some cases, counterweights are added to help reduce the weight or inertia required to move the bar from a rest position. While this counterbalance offsets the vertical weight, horizontal weight is increased. It also adds to the complexity and expense of the machine.

SUMMARY

Embodiments described herein provide for a dual action weightlifting machine which has an exercise bar assembly including slides on vertical guides slidably mounted for horizontal movement along opposite sides of a stationary frame.

According to one aspect, a stationary frame has a base and at least a first pair of upright struts at one end of the frame, each upright strut having a plurality of spaced support or racking portions such as hooks or teeth, and an exercise bar assembly is supported for guided vertical and horizontal sliding movement relative to the frame. In one embodiment, the exercise bar assembly comprises an exercise bar supported on vertical guide sleeves which are engaged on a pair of vertical guides on opposite sides of the frame, and each vertical guide is slidably engaged for horizontal sliding movement on the frame. The racking portions are designed to receive and support spaced rack engaging portions of the exercise bar in a rest position. When the user is in position gripping the exercise bar, they have the option of placing the bar on a pair of aligned hooks or teeth on the struts. The rack engaging portions in one embodiment comprise cylindrical surfaces of the exercise bar spaced outwardly from the vertical guides on each side of the machine, and in one embodiment the cylindrical surfaces are placed directly onto the respective hooks or teeth at the end of an exercise or if a user is unable to finish an exercise. In another embodiment, the rack engaging portions comprise wear-resistant sleeves rotatably mounted on portions of the exercise bar outside the vertical guides. The sleeves rotate so that the same part of the sleeve surface does not engage the rack hooks each time the bar is placed onto the rack, reducing the risk of the rack hooks cutting a groove into the rack engaging surface of the exercise bar assembly.

In one embodiment, the exercise bar has a central, user engaging portion and opposite end portions. Each end portion has a weight receiving outer end, a rack engaging portion, and a connecting portion between the racking portion and central portion of the bar. The central portion includes one or more sleeves rotatably mounted on the bar for engagement by a user when performing an exercise. In one embodiment, each connecting portion incorporates a respective vertical guide sleeve which has a central axis coplanar with the central longitudinal axis of the exercise bar. In another embodiment, the connecting portion is secured to a respective vertical guide sleeve which is offset to one side of the exercise bar.

The dual action weightlifting machine allows simultaneous horizontal and vertical movement of an exercise bar and simulates a free barbell exercise. The central rotating sleeve of the exercise bar provides free rotation, duplicating the feel of a barbell.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a dual action weightlifting exercise machine having upper and lower horizontal guides and horizontally spaced vertical guides allowing vertical and horizontal movement of a weight bearing exercise bar which has rack engaging portions outside the vertical guides which are coaxial with a user engaging portion of the exercise bar.

After reading this description, it will become apparent to one skilled in the art how to implement the invention in various alternative embodiments and alternative applications. However, although various embodiments of the present invention are described herein, it is understood that these embodiments are presented by way of example only, and not limitation.

Figure 1:
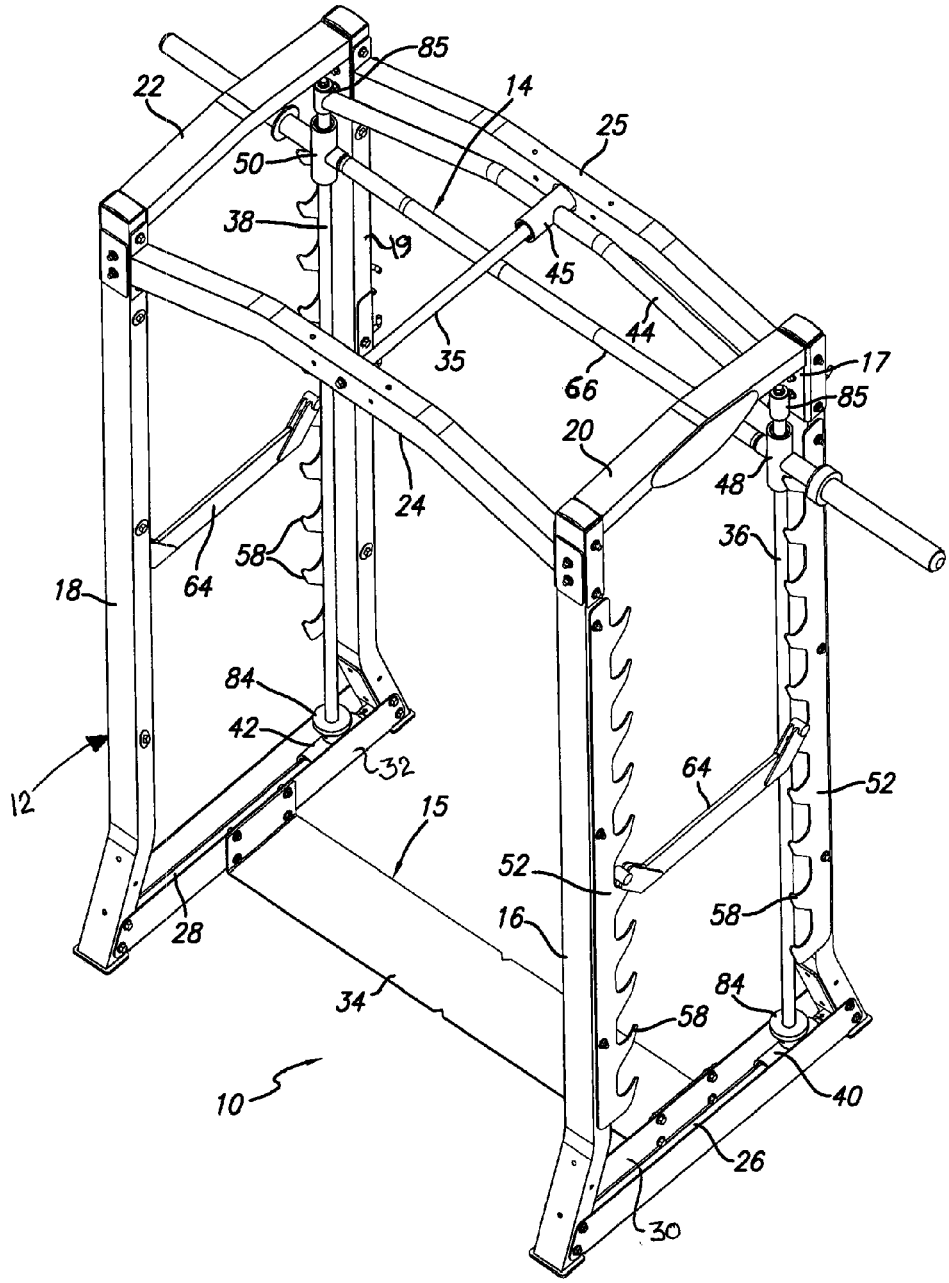
FIG. 1 is a top perspective view of a dual action weightlifting machine according to a first embodiment.
Figure 2:
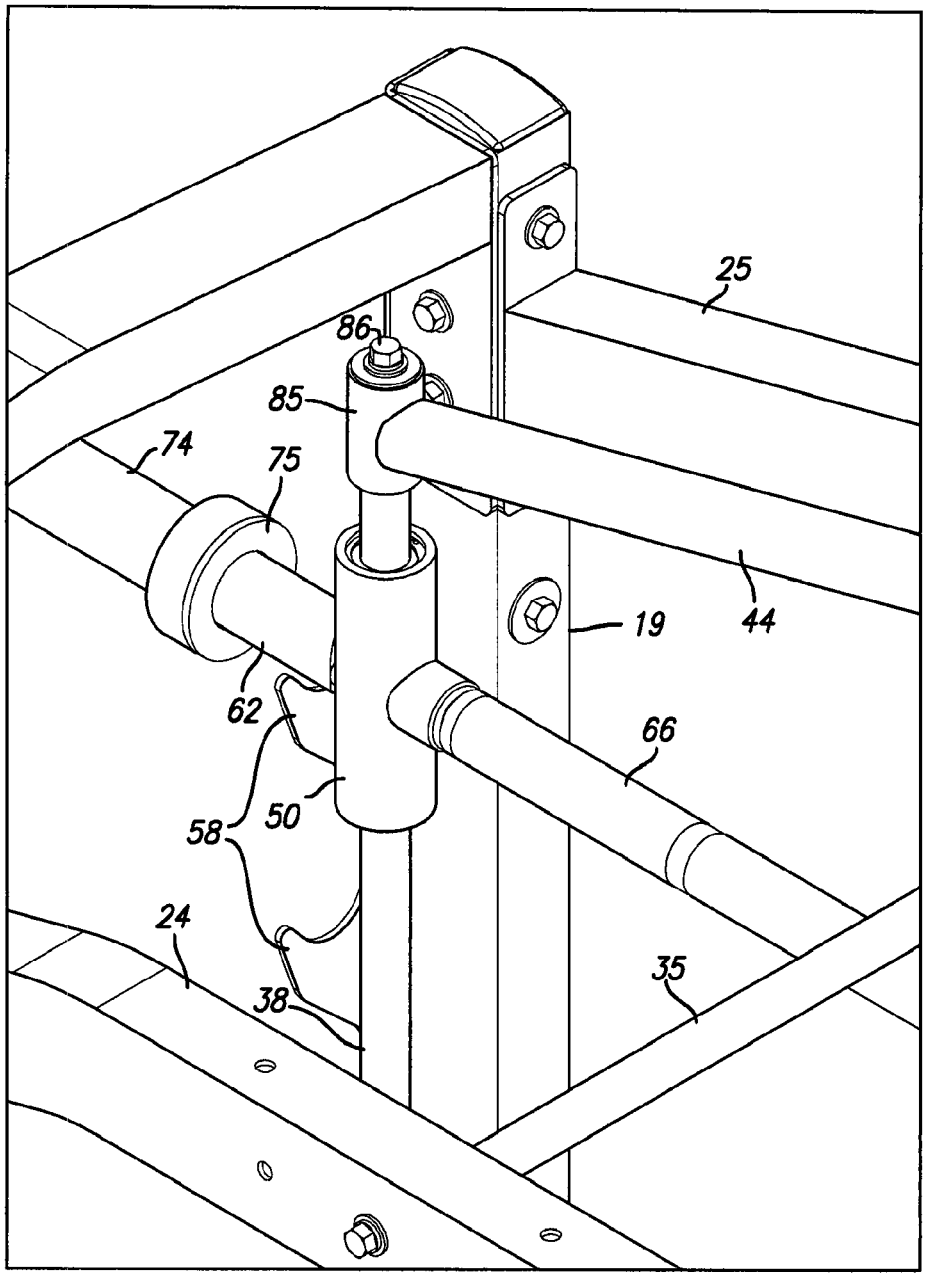
FIG. 2 is an enlarged perspective view of an upper portion of the machine, showing the engagement of the exercise bar assembly of FIG. 1 on a racking hook on one of the frame uprights.
Figure 3:
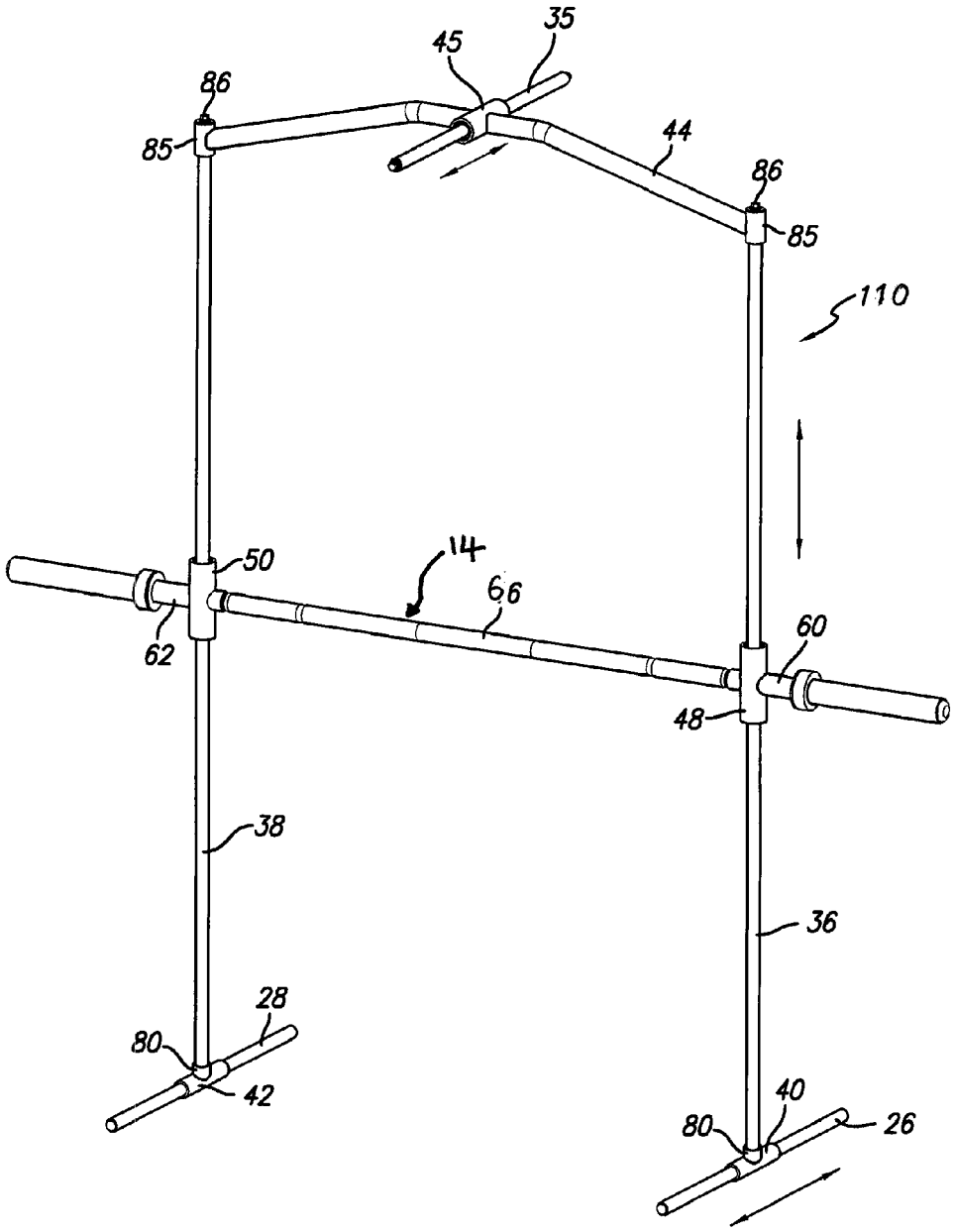
FIG. 3 is a perspective view showing only the components of the movable exercise unit of the machine of FIGS. 1 and 2, with stationary components of the machine removed apart from portions of the upper and lower horizontal guides.
Figure 4:
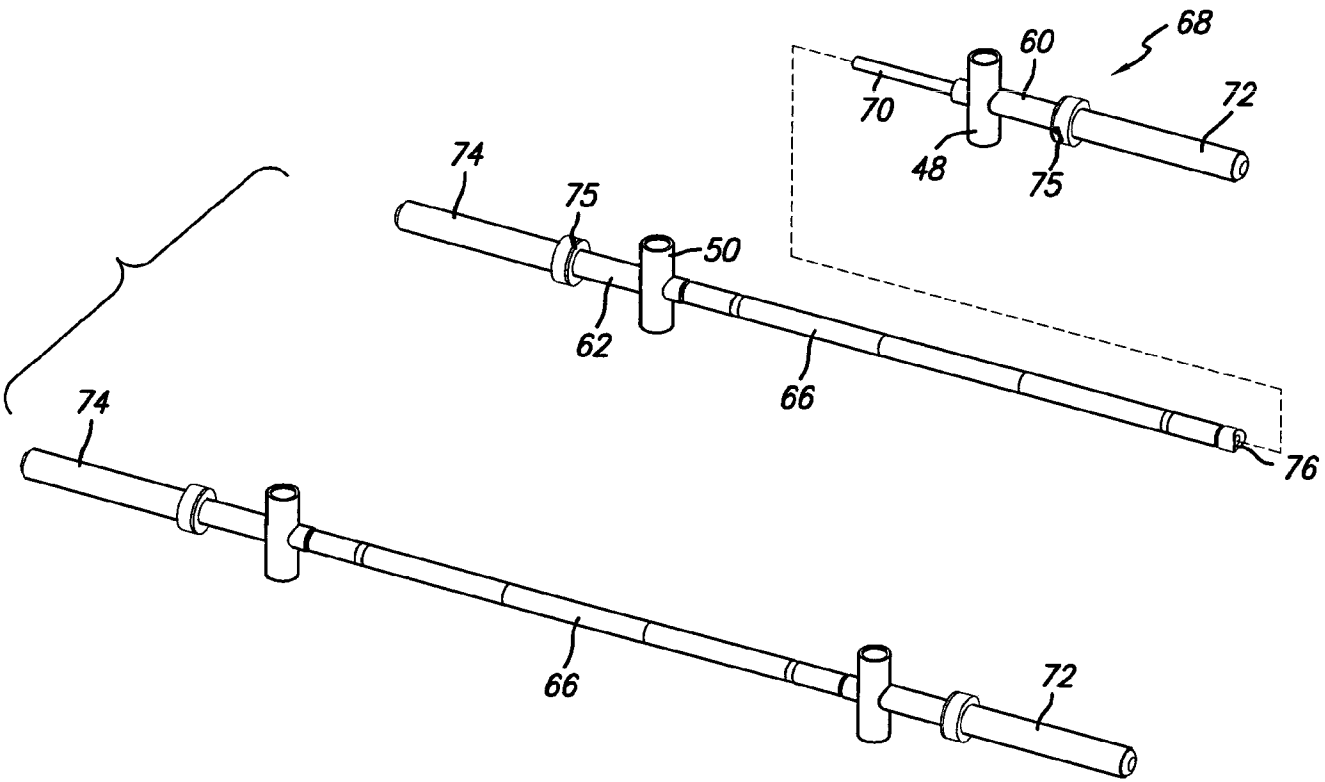
FIG. 4 is a perspective view of one embodiment of the exercise bar of the machine of FIGS. 1 to 3, with one end of the bar separated from the rotating sleeve.

FIGS. 1 to 3 illustrate a dual action weightlifting exercise machine 10 including an exercise bar 14 according to a first embodiment, while FIG. 4 illustrates exercise bar 14 in more detail. Machine 10 basically comprises a stationary main frame 12 and a moving exercise unit 110, as described in detail in U.S. Pat. No. 7,393,309, the contents of which are incorporated herein by reference. The movable parts of the exercise machine 10 are illustrated in FIG. 3, with most of the stationary frame parts removed for clarity.

The stationary frame 12 has an upper end, a lower end, a front, a rear and opposite left and right sides, and is designed to support the movable exercise unit. Frame 12 has a floor engaging base 15, first and second pairs of upright struts 16, 17 and 18, 19, respectively, upper struts 20, 22 extending between the upper ends of each pair of upright struts, and upper cross struts 24, 25, the first upper cross strut 24 extending between the upper ends of the front upright strut 16, 18 of each pair, and the second upper cross strut 25 extending between the upper ends of the second upright strut 17, 19 of each pair. A lower horizontal guide or guide assembly having a pair of lower horizontal guide bars 26, 28 extends between the lower ends of each pair of upright struts at the lower end of the machine. The guide bars 26, 28 are located in a channel or shield member 30, 32 respectively, forming part of the base of the machine, for shielding users from moving parts of the machine. A base connecting plate 34 extends between the base channel members 30, 32 and engages the floor for added stability. An upper horizontal guide or guide assembly having a single upper horizontal guide bar 35 extends between the two upper cross struts 24, 25 at a central position offset from the lower horizontal guide bars 26, 28. The lower guide assembly includes traveling members or slides 40, 42 which are slidably or movably engaged with the respective horizontal guide bars 26, 28. The upper guide assembly includes a traveling member or slide 45 movably engaged with upper guide bar 35.

As illustrated in FIGS. 1 to 3, the movable exercise unit 110 comprises a pair of vertical guides 36, 38 each slidably mounted at their lower ends on a respective horizontal guide bar 26, 28 via collars 80 on horizontal slides 40, 42, a cross bar 44 extending between the upper ends of the vertical guides and slidably connected to the upper horizontal guide bar 35 via upper horizontal slide 45, and a weight bearing exercise bar 14 extending between the vertical guides and slidably linked to the vertical guides by vertical slides 48, 50. Bumpers or stops 84 are provided on the vertical guides above collars 80, as illustrated in FIG. 1. The bumpers are omitted in FIG. 3 for clarity. The exercise unit arrangement provides simultaneous vertical and horizontal guided movement of the exercise bar 14, as indicated by the arrows in FIG. 3. Opposite ends of cross bar 44 are secured to the upper ends 86 of vertical guides 36 via collars 85. Portions of the lower and upper horizontal guide bars of the frame are included in FIG. 3 for clarity. The vertical guides 36, 38 move horizontally back and forth on the lower guide bars 26, 28 and upper guide bar 35, while the exercise bar 14 can move vertically up and down on the vertical guides, providing for simultaneous horizontal and vertical movement of the exercise bar.

Figure 5A:
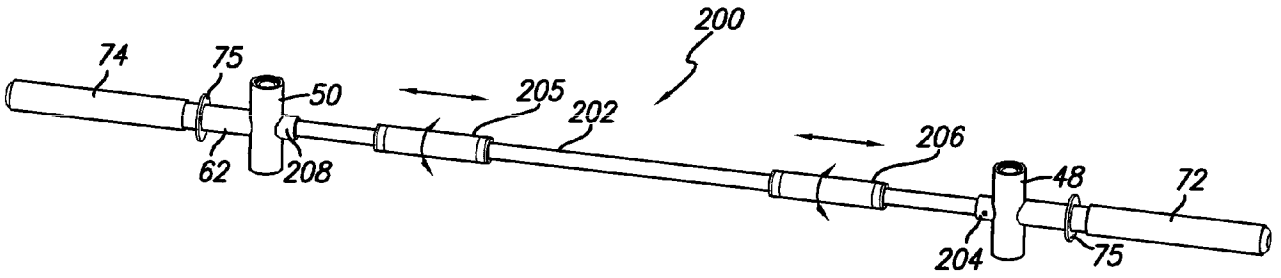
FIG. 5A is a perspective view of a modified exercise bar with two rotating hand grip sleeves.
Figure 5B:
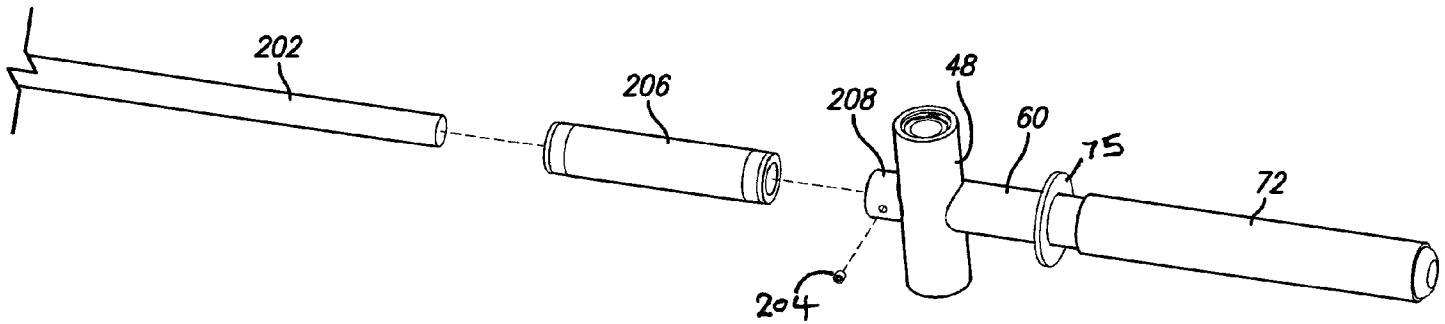
FIG. 5B is an exploded perspective view illustrating the separate components at one end of the exercise bar of FIG. 5A.
Figure 6:
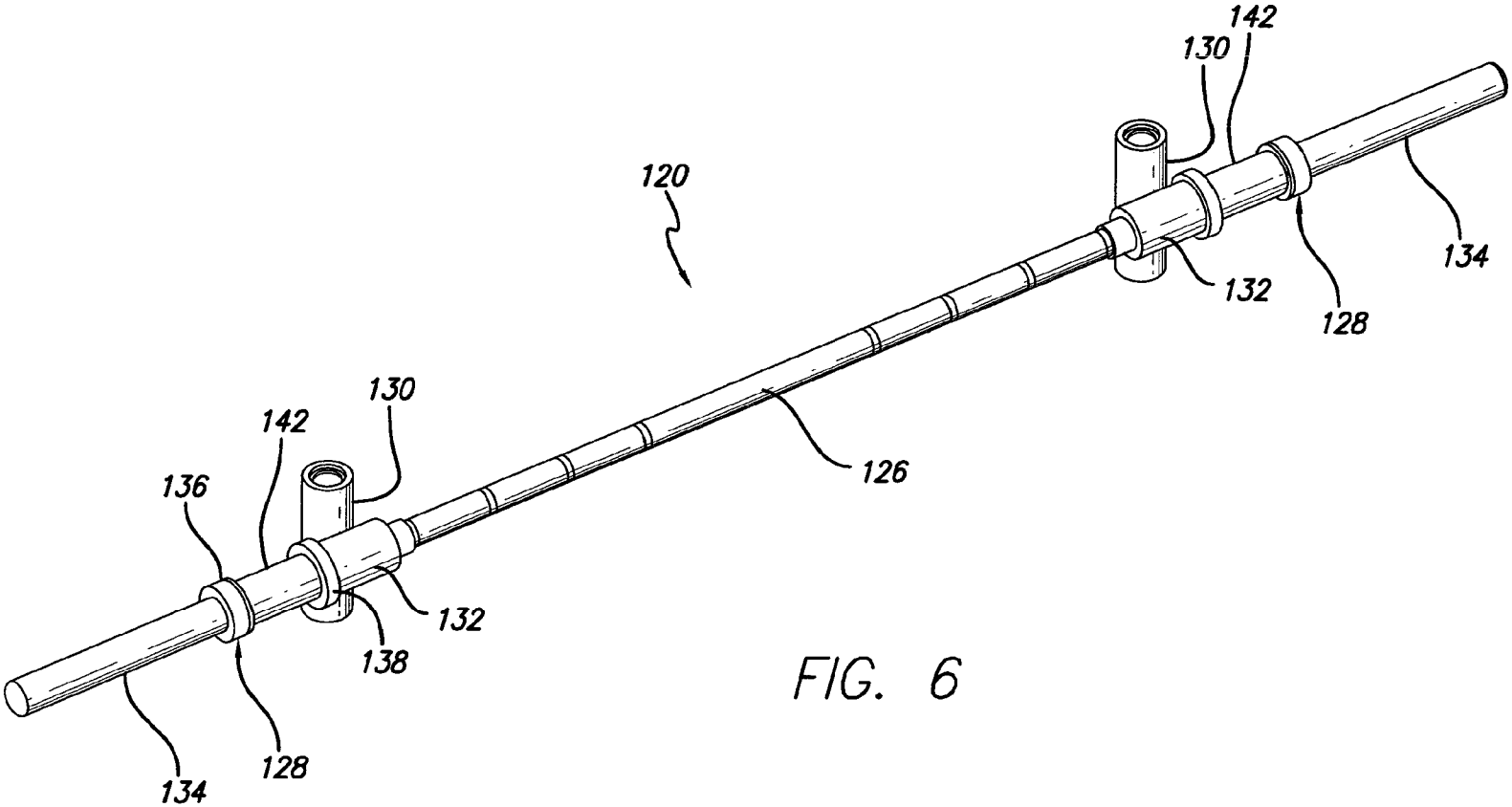
FIG. 6 is a perspective view of another modified exercise bar.
Figure 7:
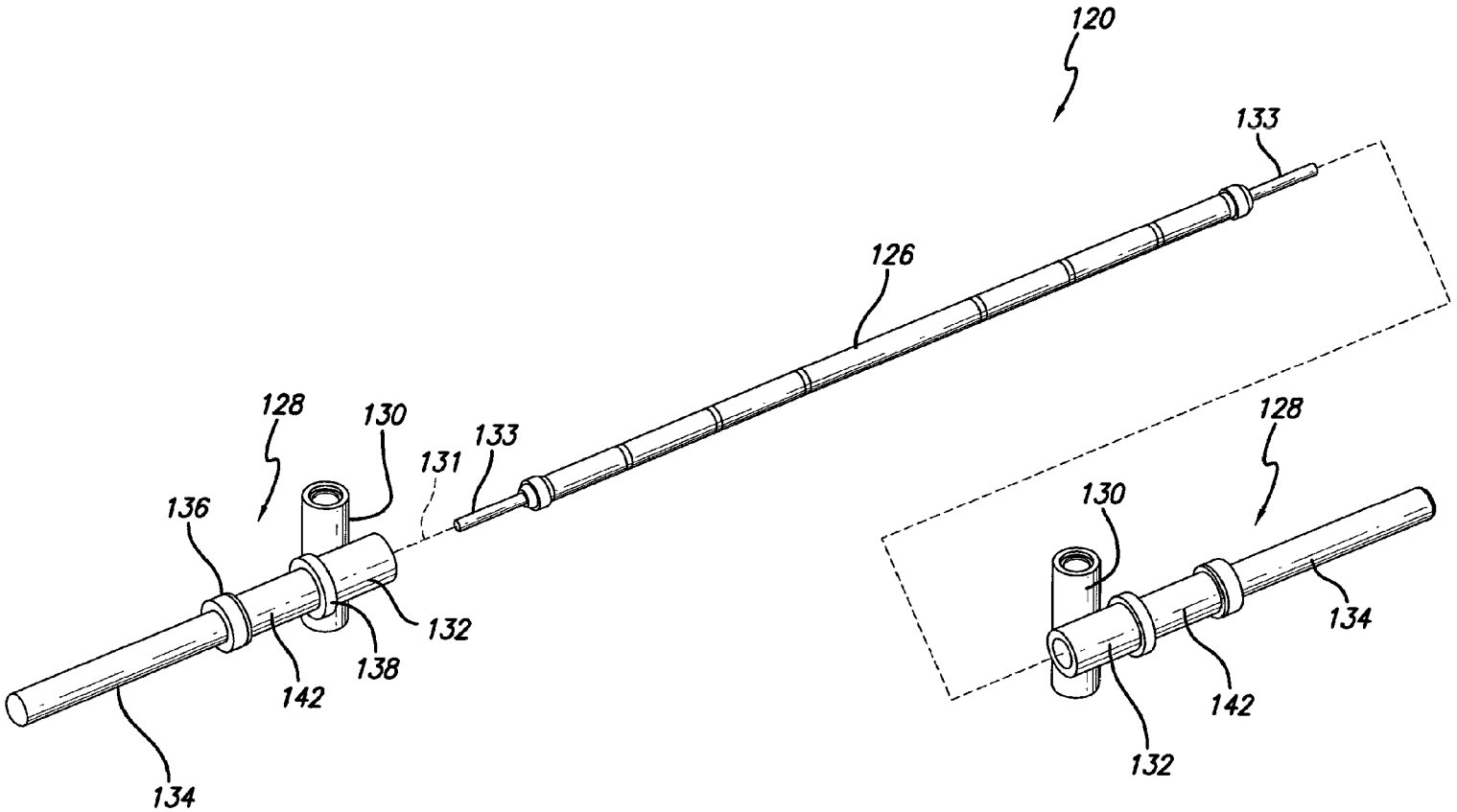
FIG. 7 is a perspective view similar to FIG. 6 but showing end portions of the exercise bar separated from the central portion.

Exercise bar 14 is illustrated in more detail in FIG. 4, with FIGS. 5A and 5B illustrating a modified embodiment. Exercise bar 14 has a central portion or sleeve 66 and opposite end portion 68. Each end portion 68 incorporates a respective vertical slide 48, 50, and has an inwardly extending shaft or axle 70 on which a respective end of the sleeve 66 is rotatably engaged. A weight receiving end 72, 74 projects outwardly from the respective vertical slide 48, 50, and a rack engaging portion 60, 62 is located between the respective slide 48, 50 and end 72, 74. An annular stop with a bumper 75 is provided between the weight receiving outer end 72, 74 of each end portion 68 and the hook or rack engaging portion 60, 62. A bushing 76 at each open end of the sleeve 66 releasably retains the rotating sleeve on the respective axle 70. This arrangement provides a freely rotatable sleeve for gripping by a user when performing exercises, with the sleeve having 360 degree, unrestrained rotation. The hollow sleeve construction provides a much lighter weight exercise bar than was used in many previous designs, and the vertical slides 48 and 50 are in line with the axis of the exercise bar, providing better weight distribution since the traveling exercise unit is centered on the exercise bar.

FIGS. 5A and 5B illustrate a modified exercise bar 200. Rather than a single hollow rotating sleeve 66 extending between the vertical slides 48, 50, as in FIG. 4, this embodiment has a bar 202 extending between the vertical slides and rigidly secured to the vertical slide at each end via set screws 204, and a pair of shorter sleeves 205, 206 rotatably mounted on bar 202. Bar 202 extends through the sleeves and engages in short collar 208 projecting from the respective sleeve, and is secured in position via the set screw 204 extending through the collar and bar. The bar may be a solid bar or may be hollow to reduce the overall weight of the assembly. The sleeves 205, 206 are free to slide back and forth along the bar 202 and to rotate through 360 degrees about the bar, as indicated in FIG. 5A. The bumper portion of each annular stop 75 is omitted for clarity in FIGS. 5A and 5B but is identical to the bumpers illustrated in FIG. 4.

The provision of two rotating hand grip sleeves which are slidably mounted on an exercise bar as in FIGS. 5A and 5B provides greater versatility in hand grip adjustment both before and during an exercise movement. When the bar is pushed or pulled during a lifting exercise, the hands can diverge or converge in order to duplicate the types of exercises performed with separate dumbbells, such as a dumbbell press. The user can also adjust the width of their handgrip to the most comfortable position.

The main frame includes a rack assembly for supporting the exercise bar 14 in multiple possible positions when not in use. The rack assembly comprises vertical rack plates 52 mounted on each of the upright struts 16, 17, 18 and 19, as illustrated in FIGS. 1 and 2. The vertical rack plate 52 on upright strut 18 is not visible, but is identical in position to the rack plate 52 on the other front upright strut 16. The rack plates each have a series of spaced teeth or upwardly directed hooks 58, with the hooks on front upright struts 16 and 18 facing the hooks on the rear upright struts 17 and 19, and the hooks on the front upright struts and rear upright struts all aligned with one another. When a user wishes to place the exercise bar in a rest position, they simply engage rack engaging portions 60, 62 of the bar 14 at a desired height in a respective pair of aligned hooks 58 on the two front upright struts 16, 18 or the two rear upright struts 17, 19. Hook or rack engaging portions 60, 62 are immediately adjacent and outboard of the respective vertical slides 48 and 50. FIG. 3 is an enlarged view illustrating the engagement of hook or rack engaging portion 62 at one end of the exercise bar in the uppermost hook 58 on the upright strut 17. Weight plates can be added or removed from weight receiving ends 72, 74 of the exercise bar when it is in the rest position racked onto two of the toothed plates 52, and the exercise bar can be left in this position for storage purposes when the machine is not in use.

A pair of safety tiers 64 is provided for engagement between respective pairs of rack plates 52 on opposite sides of the main frame, as best illustrated in FIG. 1. The tiers 64 have pins at their ends which can engage on hooks or teeth 58 at a desired height. The safety tiers can be adjusted as necessary, depending on the type of exercise, to provide the user with protection against losing control of a weighted exercise bar.

Once the user engages the weight receiving exercise bar 14 by gripping sleeve 66 and moves it from a rest position on the toothed plates and into an exercise ready position, as indicated in FIG. 3, the entire movable exercise unit 110 acts as one device to provide simultaneous horizontal and vertical movement. This allows a large variety of different exercises to be performed. The exercise unit 110 is relatively light weight due to the hollow sleeve design of the exercise bar 14 and the use of only three horizontal slides rather than four which was common in the past, producing a smoother, and more fluid exercise motion. By reducing the weight of the exercise bar below that of a standard Olympic bar, this machine allows a novice user to handle the weight comfortably and safely, without needing the costly inclusion of any counter-balancing means.

The machine of FIGS. 1 to 4 has a reduced number of moving components in order to reduce the weight of the movable exercise unit, thus reducing the inertia required to initiate or change directions on the horizontal plane. Some free weight exercises require the horizontal motion to be paused or the direction of horizontal movement to be changed at the mid point of an exercise. The reduced weight of the movable exercise unit in this machine allows such exercises to be performed more easily. At the same time, the elimination of framework and reduction of the number of components reduces the overall cost and complexity of the machine.

Figure 8:
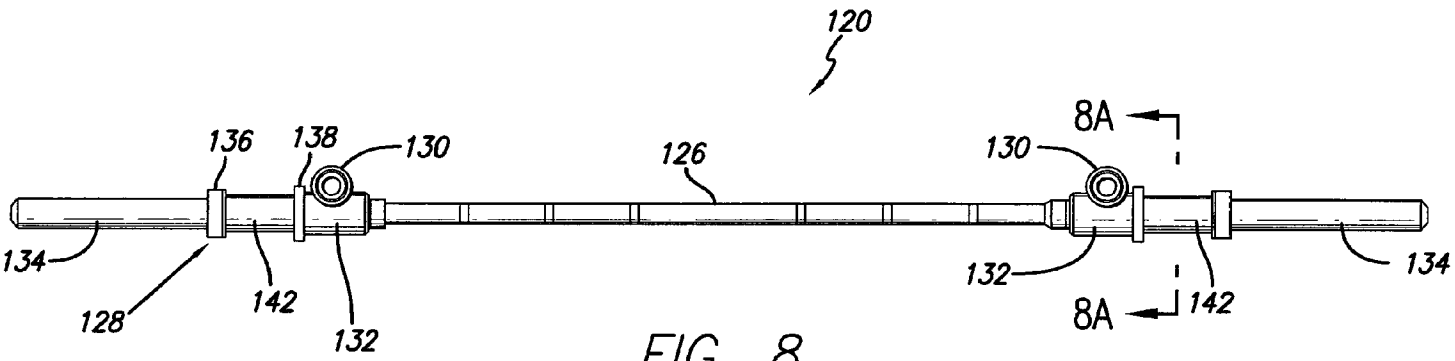
FIG. 8 is a top plan view of the exercise bar of FIGS. 6 and 7.
Figure 8A:
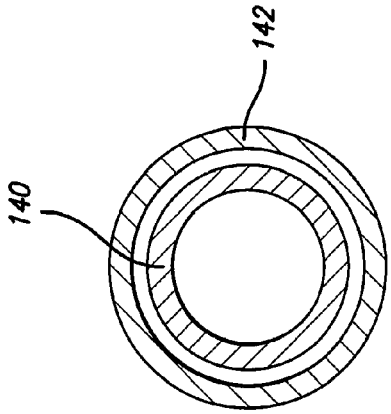
FIG. 8A is a cross-sectional view on the lines 8A-8A of FIG. 8.
Figure 9:
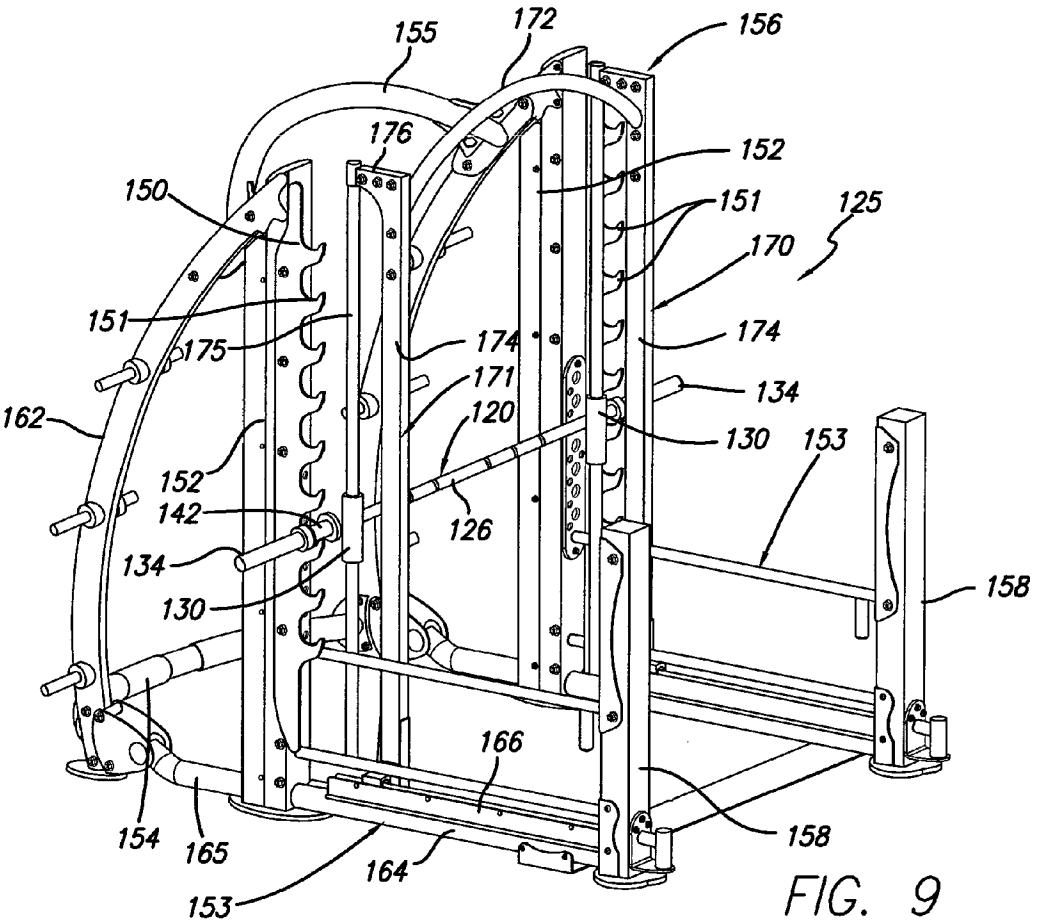
FIG. 9 is a perspective view of a modified dual action weightlifting machine using the exercise bar of FIGS. 6 to 8A.

FIGS. 6 to 8A illustrate a modified exercise bar 120 according to another embodiment which may be used in the exercise machine of FIGS. 1 to 4 in place of exercise bar 14, or in a modified exercise machine 125 as illustrated in FIG. 9. Exercise bar 120 has a central portion 126 and opposite end portions 128, with portions 126 and 128 shown separated from one another in FIG. 7. Unlike the previous embodiments, end portions 128 do not have vertical guide sleeves which are in line with the central longitudinal axis 131 of the exercise bar. Instead, each end portion has a guide sleeve 130 welded in a groove on one side of a connecting tube 132 forming part of end portion 128 as seen in FIG. 8. The central portion 126 of the exercise bar has pivot pins 133 projecting from its ends which are rotatably engaged in respective connecting tubes 132 to allow rotation of the central gripping portion 126 through 360 degrees. In this arrangement, the central longitudinal axis of the exercise bar is offset from the vertical axes of the vertical guide sleeves.

As in the previous embodiments, end portions 128 have weight receiving pegs 134 at their outer ends, and a rack engaging portion mounted between enlarged flanges 136, 138 at the inner, opposing ends of the respective weight peg 134 and connecting tube 132. Each rack engaging portion comprises a wear-resistant sleeve 142 rotatably mounted on a mounting portion 140 (FIG. 8A) extending between flanges 136, 138. Thus, the central portion 126 and wear sleeves 142 rotate independently from one another.

The vertical guide sleeves 130 of exercise bar 120 may be slidably engaged on vertical guides 36, 38 of exercise machine 10 in place of exercise bar 14. Alternatively, either exercise bar 14 or exercise bar 120 may be mounted on vertical guides 144 of exercise machine 125 of FIG. 9. Exercise machine 125 is similar to the dual action weightlifting machine described in co-pending application Ser. No. 11/940,009 filed on Nov. 14, 2007, the contents of which are incorporated herein by reference, with the only difference being the replacement of the exercise bar of that machine with the exercise bar 120 described above in connection with FIGS. 6 to 8B. Unlike exercise machine 10 of the first embodiment, machine 125 has only one racking assembly at one end of the machine, comprising a pair of toothed plates 150 which are secured on the outer face of a respective upright 152 of the main frame. Each plate 150 has a series of vertically spaced teeth or rack outs 151 at its outer edge.

Machine 125 basically comprises a stationary main frame assembly having opposite left and right side frames 153 connected by a lower cross strut or support 154 and an upper cross strut or support 155, a traveling frame or exercise unit 156 which is slidably mounted for horizontal sliding movement on the side frames, and weight bearing exercise bar assembly 120 which is slidably mounted for vertical sliding movement on the traveling frame or exercise unit. An exercise area is located between the left and right side frames and a user stands in this area when performing exercise. A forward end of the stationary frame assembly is open to allow users to easily enter and exit the exercise area.

Each side frame 153 has a first or front ground engaging upright 158, second ground engaging upright 152 which is taller than the first upright and carries a respective toothed plate or rack assembly 150, and a rear upright support 162 which curves upwardly and forwardly from its lower, ground engaging end and has an upper end secured to the upper end of the second upright. On each side of the frame, a first horizontal base tube 164 extends between the respective first and second vertical uprights at a location proximate their lower, floor engaging ends, and a second base tube 165 extends between the second vertical upright and the rear support proximate their lower, ground engaging ends. A horizontal slide assembly slidably connects opposite sides of the traveling frame to the right and left side frames for guided horizontal sliding movement of the traveling frame and exercise bar. The horizontal slide assembly includes horizontal guides 166 mounted on each side frame and extending between the first and second uprights at the lower end portion of the respective side frame, parallel to the first base tube. Each horizontal guide 166 is slidably engaged by a respective horizontal slide associated with the traveling frame.

The traveling frame 156 comprises left and right vertical side portions or uprights 170, 171 positioned inboard of the left and right side frame, and connected together by a single upper cross support 172. Each vertical upright comprises a vertical strut 174 and a vertical guide 175 extending parallel to the vertical strut and secured to the vertical strut by a cross piece or bracket 176 at the upper end of strut 174. Each vertical upright of the traveling frame is secured at its lower end to the first and second horizontal slides of the horizontal slide assembly, which are slidably engaged on the horizontal guides 166.

In the embodiment of FIG. 9, the vertical guide sleeves 130 of exercise bar assembly 120 are slidably engaged on the respective vertical guides 175 at the side portions of the traveling frame 156, with the user engaging portion 126 of the exercise bar positioned to the rear of vertical guides 175 and guide sleeves 130, facing the racking assembly or plates 150 on frame uprights 152. FIG. 9 illustrates the bar in a racking position with the rotatable wear sleeves 142 or rack engaging portions of the exercise bar engaging a pair of aligned hooks 151 on racking plates 150.

The rotating, rack engaging wear sleeves 142 in the embodiment of FIGS. 6 to 8A are separate from the rotating user engaging sleeve 126 and rotate independently from sleeve 126. This helps to reduce wear as the bar hits and slides into the stationary rack outs or hooks 151 on the main frame, increasing the life of the components. With a stationary rack engaging portion on the exercise bar, as in FIGS. 4 and 5, it has been found that the bar engaging edges of the plate-like hooks 151 act like a knife and cut into the racking portion of the exercise bar assembly, potentially reducing its lifetime and making it harder to lift the bar off the hooks into an exercise ready position.

The weightlifting exercise machines described above have a traveling exercise unit of reduced overall weight and provide a smoother, more fluid exercise motion. The exercise bar is lighter than in prior art machines because of the design of the user engaging portion as a hollow revolving sleeve. Although some prior art exercise bars do have revolving sleeves, these have limited rotation since they typically have hooks mounted near each end for engaging pinning holes on vertical struts in the rest position. The rotation is therefore limited by a stop mechanism to avoid rotating the hooks into a potentially dangerous position. In contrast, the hollow revolving sleeve of the exercise arm in the above embodiments can rotate freely through 360 degrees, when it is in use and when the assembly is stored in the racking position. This allows the user to perform exercises such as curls which require different grips on the exercise bar and rotation during the exercise movement, and also makes it easier to lift the bar from a storage position on the rack. The rack engaging portion is coaxially aligned with the user engaging portion of the bar but is completely separate from the user engaging portion. The rotating wear sleeves in the exercise bar assembly of FIGS. 6 to 8A help to reduce wear and increase the lifetime of the exercise bar assembly, particularly when the machine is installed on a ship or other high-vibration locations.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A dual action weightlifting machine, comprising:

a stationary frame having opposite first and second sides and opposite ends defining an exercise area;

first and second spaced vertical guides slidably mounted on the first and second sides, respectively, of the stationary frame for horizontal sliding movement relative to the frame;

a horizontally extending exercise bar assembly having spaced first and second vertical slides slidably mounted on the respective first and second vertical guides for vertical sliding movement relative to the frame, and an exercise bar associated with the slides and having a user engaging portion extending across the exercise area for gripping by a user when performing weightlifting exercises, opposite first and second weight receiving end portions extending outwardly from the respective first and second sides of the frame for receiving one or more selected weights, and at least a first rack engaging portion comprising a sleeve rotatably mounted on the exercise bar between the user engaging portion and the first weight receiving end portion, the user engaging portion, rack engaging sleeve and weight receiving portions being coaxially aligned along a common central longitudinal axis of the exercise bar;

the stationary frame including a rack assembly which has at least one support portion which directly engages the cylindrical surface of the rack engaging sleeve at a position spaced transversely outward from the first vertical slide at the first side of the frame in a racked position of the exercise bar assembly;

the user engaging portion of the exercise bar assembly being rotatably mounted relative to the vertical slides and freely rotatable through 360 degrees; and the user engaging portion and rack engaging sleeve rotating independently from one another.

2. The machine of claim 1, wherein the exercise bar extends perpendicular to the vertical guides and has first and second rack engaging portions, the first and second weight receiving end portions projecting in a generally outward direction from the first and second rack engaging portions, respectively, each rack engaging portion comprising a rack engaging sleeve rotatably mounted on the exercise bar and configured to rotate independently from the user engaging portion and the other rack engaging sleeve.

3. The machine of claim 1, wherein the first and second vertical slides comprise first and second sleeves slidably engaged over the respective first and second vertical guides.

4. The machine of claim 1, wherein the exercise bar assembly further comprises first and second mounting portions projecting inwardly relative to the opposite first and second sides of the frame, and the user engaging portion has opposite ends rotatably engaged with the first and second mounting portions, respectively.

5. A dual action weightlifting machine, comprising:

a stationary frame having opposite side portions and opposite first and second end portions defining an exercise area, and including a racking assembly on at least the first end portion, the racking assembly having a plurality of support portions;

first and second spaced vertical guides slidably mounted on the stationary frame for horizontal sliding movement relative to the frame;

a horizontally extending exercise bar having a user engaging portion for gripping by a user when performing weightlifting exercises, first and second rack engaging portions at opposite ends of the user engaging portion, and opposite first and second weight receiving end portions extending outwardly from the first end second rack engaging portions, respectively, for receiving one or more selected weights;

each rack engaging portion comprising a sleeve rotatably mounted on the exercise bar having a smooth, cylindrical surface configured for direct engagement with a respective support portion of the racking assembly in a racked position of the exercise bar; and spaced first and second vertical slides secured to the exercise bar at positions spaced inward from the first and second rack engaging portion, respectively, and slidably mounted on the first and second vertical guides for vertical sliding movement relative to the frame;

the user engaging portion of the exercise bar which is gripped by a user being rotatably mounted relative to the vertical slides and rack engaging portions and being freely rotatable through 360 degrees, whereby the user's hands may be rotated relative to the vertical slides during a weight lifting exercise; and the user engaging portion, rack engaging portions, and weight receiving end portions of the exercise bar being coaxially aligned and having a common central longitudinal axis which extends transverse to the vertical slides.

6. The machine as claimed in claim 5, wherein at least the first end portion of the stationary frame has a pair of spaced upright struts, the racking assembly comprises a racking plate projecting from each upright strut toward the opposite end of the exercise area and the support portions comprise a series of vertically spaced hooks on each plate, the exercise bar being movable between exercise positions spaced from the upright struts and at least one racking position, the cylindrical surface of the first rack engaging portion directly engaging a selected hook on the first upright strut and the cylindrical surface of the second rack engaging portion directly engaging an aligned hook on the second upright strut in the racking position.

7. The machine as claimed in claim 6, wherein the racking plates are oriented perpendicular to the central longitudinal axis of the user engaging portion of the exercise bar.

8. The machine as claimed in claim 6, wherein the user engaging portion and weight receiving end portions of the exercise bar assembly are coaxial with the central axes of the upwardly facing hooks in which the cylindrical surfaces of first and second rack engaging portions are engaged in the racking position.

9. The machine as claimed in claim 5, wherein a racking assembly is provided only on the first end portion of the frame.

10. The machine as claimed in claim 5, wherein each rack engaging portion comprises a cylindrical wear sleeve rotatably mounted between a respective slide and weight receiving end portion of the bar, each wear sleeve being rotatable relative to the slides independently from the user engaging portion, the outer surfaces of the respective wear sleeves comprising the cylindrical surfaces of the first and second rack engaging portions, respectively.

11. The machine as claimed in claim 10, wherein the vertical slides have vertical axes lying in a first plane offset from the longitudinal central axis of the exercise bar, and the exercise bar is positioned between the vertical slides and the first end portion of the frame.

12. A dual action weightlifting machine, comprising:

a stationary frame including a racking assembly having a plurality of support portions;

first and second spaced vertical guides slidably mounted on the stationary frame for horizontal sliding movement relative to the frame, each vertical guide having a central vertical axis;

a horizontally extending exercise bar assembly having spaced first and second vertical slides slidably mounted on the vertical guides for vertical sliding movement relative to the frame, a user engaging portion for gripping by a user when performing weightlifting exercises, at least one rack engaging portion which directly engages a selected support portion of the rack assembly in a racked position of the exercise bar assembly, and opposite first and second end portions for receiving one or more selected weights;

the user engaging portion located between the vertical slides and not extending outwardly beyond the vertical slides;

the user engaging portion being rotatably mounted relative to the vertical slides and freely rotatable through 360 degrees, whereby the user's hands may be rotated relative to the vertical slides during a weight lifting exercise;

the rack engaging portion comprising a wear sleeve rotatably mounted relative to the vertical slides and adapted to rotate independently from the user engaging portion.

13. The machine of claim 12, wherein the first and second vertical slides comprise first and second sleeves slidably engaged over the respective first and second vertical guides.

14. The machine of claim 12, wherein the exercise bar assembly has a connecting portion between each end of the user engaging portion and the respective weight receiving end portion which is fixed relative to the respective vertical slide, each connecting portion having an inner end rotatably engaged with a respective end of the user engaging portion of the exercise bar assembly, and first and second rack engaging portions comprising first and second wear sleeves rotatably engaged on respective connecting portions of the exercise bar assembly.

15. The machine of claim 14, wherein the user engaging portion, connecting portions, wear sleeves, and weight receiving end portions of the exercise bar are coaxially aligned on a common longitudinal central axis, and the central axis is offset to one side of the vertical slides between the vertical slides and the racking assembly on the stationary frame.

16. A dual action weightlifting machine, comprising:

a stationary frame having opposite first and second ends and opposite first and second sides, and a pair of first upright struts at the first end of the frame having a plurality of vertically spaced, upwardly directed support portions, the support portions of the upright struts defining a plurality of spaced racking positions;

first and second spaced vertical guides slidably mounted on opposite sides of the stationary frame for horizontal sliding movement relative to the frame;

the horizontal spacing between the first and second vertical guides being less than the horizontal spacing between support portions of the respective upright struts;

a horizontally extending exercise bar assembly having spaced first and second vertical slides slidably mounted on the vertical guides for vertical sliding movement relative to the frame, a user engaging portion rotatably mounted relative to the vertical slides, opposite first and second end portions for receiving one or more selected weights, and spaced first and second rack engaging portions between the user engaging portion and respective weight receiving end portion, each rack engaging portion comprising a rotatably mounted wear sleeve having a smooth cylindrical surface which directly engages the support portions in a respective upright strut in the racking positions;

the user engaging portion of the exercise bar assembly having a central longitudinal axis which extends transverse to the vertical slides, and the end portions and wear sleeves having central axes which are coaxial with the central longitudinal axis of the user engaging portion;

the exercise bar assembly being movable between exercise positions spaced from the upright struts and racking positions in which the smooth cylindrical surfaces of the first and second rack engaging portions directly engage the support portions of the respective upright struts to support the exercise bar assembly on the struts; and the user engaging portion being freely rotatable through 360 degrees relative to the slides and wear sleeves in the exercise position and the racking positions, whereby the user's hands may be freely rotated relative to the vertical slides.

17. An exercise bar assembly for a dual action weightlifting machine, comprising:

an elongate exercise bar having a central longitudinal axis, the exercise bar having a central portion and opposite first and second end portions coaxially aligned with the central portion;

first and second guide sleeves secured to the first and second end portions, respectively, and having central axes which extend transverse to the central longitudinal axis of the exercise bar and which are offset to one side of the exercise bar;

each end portion of the exercise bar comprising a mounting portion for the central portion of the bar, a racking portion extending outward from the mounting portion and configured for engagement with a racking portion of a dual action weightlifting machine frame, and a weight receiving end portion configured to receive one or more weights, the guide sleeves being spaced inward from the racking portions; and each racking portion comprising a wear sleeve rotatably mounted on the exercise bar between the mounting portion and weight receiving end portion of the exercise bar.

18. The exercise bar assembly of claim 17, wherein the central portion comprises a user engaging sleeve rotatably mounted on the mounting portions at opposite ends of the central portion, the user engaging sleeve and wear sleeves being independently rotatable.

19. The exercise bar assembly of claim 17, wherein the central portion comprises a bar extending between the mounting portions and a pair of user engaging sleeves rotatably mounted on the bar.

* * * * *